US008857473B2

(12) United States Patent
Shelton

(10) Patent No.: US 8,857,473 B2
(45) Date of Patent: Oct. 14, 2014

(54) APPARATUS AND METHOD FOR DEICING

(71) Applicant: Richard D. Shelton, Story, WY (US)

(72) Inventor: Richard D. Shelton, Story, WY (US)

(73) Assignee: Richard Dale Shelton, Story, WY (US)

( * ) Notice: Subject to any disclaimer, the term of this patent is extended or adjusted under 35 U.S.C. 154(b) by 0 days.

(21) Appl. No.: 13/650,127

(22) Filed: Oct. 11, 2012

(65) Prior Publication Data

US 2013/0087235 A1 Apr. 11, 2013

Related U.S. Application Data

(60) Provisional application No. 61/545,856, filed on Oct. 11, 2011, provisional application No. 61/712,253, filed on Oct. 10, 2012.

(51) Int. Cl.
*E03B 7/14* (2006.01)

(52) U.S. Cl.
CPC ..... *E03B 7/14* (2013.01)
USPC ..... 138/32; 138/35

(58) Field of Classification Search
USPC ..... 138/35, 32; 141/290
See application file for complete search history.

(56) References Cited

U.S. PATENT DOCUMENTS

| | | | | |
|---|---|---|---|---|
| 168,352 | A | | 10/1875 | Sloan |
| 337,408 | A | | 3/1886 | Kearns |
| 458,503 | A | | 8/1891 | Simpson |
| 501,744 | A | | 7/1893 | Streeper |
| 2,989,978 | A | | 6/1961 | Gresko |
| 3,319,709 | A | | 5/1967 | Strunk |
| 3,767,117 | A | | 10/1973 | Baker |
| 4,102,358 | A | | 7/1978 | Sherock |
| 4,124,039 | A | | 11/1978 | St. Laurent |
| 4,250,925 | A | | 2/1981 | Mast |
| 4,254,821 | A | | 3/1981 | Matsuda et al. |
| 4,449,553 | A | | 5/1984 | Sullivan et al. |
| 558,992 | A | | 4/1986 | Silver |
| 4,986,311 | A | * | 1/1991 | Mikkelson ..... 138/35 |
| 5,193,587 | A | | 3/1993 | Miller, Jr. |
| 5,715,869 | A | | 2/1998 | Patterson |
| 5,859,953 | A | | 1/1999 | Nickless |
| 6,041,821 | A | | 3/2000 | Grossman |
| 6,305,422 | B1 | | 10/2001 | Grossman |
| 7,100,540 | B2 | | 9/2006 | Vaughan |

FOREIGN PATENT DOCUMENTS

| | | |
|---|---|---|
| JP | 2009293279 | 12/2009 |
| KR | 20000052181 | 8/2000 |

* cited by examiner

*Primary Examiner* — Patrick F Brinson
(74) *Attorney, Agent, or Firm* — Premier Law Group, PLLC

(57) ABSTRACT

An apparatus and method for thawing frozen lines. Water is heated and supplied under pressure to the inside of a frozen line such as a frozen plastic or metal pipe. In one non-limiting embodiment the invention comprises an air compressor, a plurality of tanks, a water heater element located in one tank, and a reel of flexible tubing. In a preferred embodiment the complete kit is mounted on a carrying device, which can be maneuvered manually through standard size doorways. In one embodiment a water delivery nozzle made of heat conducting metal is fitted to one end of the tubing. The compressor can be an electrically powered air compressor thus allowing the invention to be used inside buildings. In another embodiment deicing agent is directed into a frozen pipe in controlled pulses to further aid thawing of frozen lines.

1 Claim, 13 Drawing Sheets

| TABLE 1 | |
|---|---|
| part # | |
| 100 | deicer apparatus 100 |
| 120 | air compressor 120 |
| 140a, 140b, 140c | first tank 140a, second tank 140b, third tank 140c |
| 150a | shutoff valve 150a |
| 155 | siphon 155 |
| 157a, 157b | first and second opposite ends 157a and 157b of siphon 155 |
| 160 | spool 160 |
| 180 | carrying device 180 |
| 200 | framework support 200 |
| 220, 220e | main hose 220, end 220e of main hose 220 |
| 240, 240e1, 240e2 | return line 240; first 240e1 and second 240e2 opposite ends of the return line 240 |
| 250, 255 | thermostat 250; heater element 255 |
| 260 | union tee 260 |
| 267 | deicing agent pump system |
| 270 | plug 270 |
| 280 | frozen pipe 280 |
| 300 | nozzle 300 |
| 302 | shut-off valve 302 |
| 304, 306 | pressure regulator 304; pressure switch 306 |
| 308, 310 | compressed airline 308; compressed airline 310 |
| 320 | power supply 320 |
| 340 | shut off valve 340 |
| 360 | water line 360 |
| 380, 400 | shut off valve 380; shut off valve 400 |
| 420 | water line 420 |
| 440 | second tube 440 |
| 460 | container 460 |
| 480, 500 | pump 480; pump switch 500 |
| 520 | mushroom plug 520 |

*Fig. 11*

APPARATUS AND METHOD FOR DEICING

CROSS-REFERENCE TO RELATED APPLICATIONS

This application claims the benefit of priority from U.S. Provisional Patent Application Ser. No. 61/545,856 (filed Oct. 11, 2011, i.e., Oct. 11, 2011), and U.S. Provisional Patent Application Ser. No. 61/712,253 (filed Oct. 10, 2012, i.e., Oct. 10, 2012). The entire contents of Provisional Patent Application Ser. Nos. 61/545,856 and 61/712,253 are incorporated herein by reference in their entirety.

STATEMENT REGARDING FEDERALLY SPONSORED RESEARCH OR DEVELOPMENT

Not Applicable.

FIELD OF THE INVENTION

This invention relates to deicer systems. More specifically, the invention is a deicer apparatus and method for thawing lines such as frozen plastic and metal pipes.

BACKGROUND OF THE INVENTION

As noted in U.S. Pat. No. 5,715,869 in conditions of extreme cold, water pipes supplying domestic water sometimes freeze. In former times these pipes were usually made of metal, and could be thawed using electrical resistance heating or external heating. Nowadays, however, many pipes are made of plastic and cannot be thawed by these methods. Apart from this, use of electricity has its dangers. Therefore there is a need for deicing devices that can be used to thaw metal and non-metallic pipes.

U.S. Pat. No. 4,124,039 describes a machine for thawing frozen pipes by forcing hot water from a heated water reservoir through a flexible tube advanced into the pipe as the ice melts with means to return water and melt to the reservoir through a duct sealed to the end of the pipe.

U.S. Pat. No. 4,449,553 describes an apparatus for thawing a pipe having a frozen blockage therein, the apparatus including a self-contained unit on wheels, the unit including a tank for holding water, an electric immersion heater in the tank for heating the water to a temperature of 100°-150° F., a pump supported on the unit, a foot switch connected to the pump, a pressure control connected to the pump, a reel of flexible polyurethane hose and a reel of return hose mounted on respective sides of the tank, and a conical coupling for connecting to one end of the frozen pipe, the coupling including a compression fitting for engaging around the flexible hose, and a T-shaped return fitting for connecting to the return hose. The flexible hose is pushed through the compression fitting towards the frozen blockage and emits a stream of water under pressure from the pump that erodes and eliminates the frozen blockage, and return water is pushed from the blockage back to the return fitting and through the return hose to the container thereby providing a closed loop system.

U.S. Pat. No. 5,715,869 describes an apparatus for thawing frozen pipes or for cleaning pipes, for use with a source of warm thawing water or cleaning water, a source of compressed air, and a flexible tube suitable for being inserted into the end of a pipe through guide means to feed the water into the pipe while the tube is being advanced into the pipe. The apparatus comprises a valved water conduit having an inlet for connection to the source of water and an outlet for connection to the flexible tube, this conduit having a movable valve. A compressed air powered drive, usually a rotator, connectable to the source of compressed air, is arranged to move the valve in such manner as to continually interrupt the flow of water in the conduit and so to produce a pulsating flow of water in the tube for thawing ice in the frozen pipe or cleaning the pipe. The rotator for the valve may be a compressed air driven ratchet drive. A valve may also be provided for injecting air into the pipe to clear out ice or dirt.

U.S. Pat. No. 6,041,821 describes a micro heater assembly, provided with a micro heater on the distal end of an elongated support wire. Micro heater is insertable into a frozen pipe to reach the frozen area of the pipe whereat to thaw pipe from within safely and cost-effectively.

None of the above inventions and patents, taken either singly or in combination, is seen to describe the instant invention as claimed,

SUMMARY

An apparatus and method for thawing frozen lines such as, but not limited to, household and factory water lines. Water is heated and supplied under pressure to the inside of a frozen line such as a frozen plastic or metal pipe. In one non-limiting embodiment the invention is a kit comprising of an air compressor, a plurality of tanks, a water heater element located in one tank, and a reel of flexible tubing. An optional water return line is used in conjunction with a union tee to allow water, which would during normal operation include melted ice, to be cycled back through the apparatus of the invention thus saving on water usage and energy consumption.

In a preferred embodiment the complete kit is mounted on a carrying device such as a cart which can be maneuvered manually through standard size doorways. In one embodiment a water delivery nozzle made of heat conducting metal is fitted to one end of the tubing. The compressor can be an electrically powered air compressor thus allowing the invention to be used inside buildings. In another embodiment deicing agent is directed through a second tube into a frozen pipe in controlled pulses to further aid thawing of frozen lines.

BRIEF DESCRIPTION OF THE DRAWINGS

FIG. 11 shows a Table of listed parts.

Similar reference characters denote corresponding features consistently throughout the attached drawings.

PREFERRED EMBODIMENTS OF THE INVENTION

This invention relates to deicer systems. More specifically, the invention is a deicer apparatus and method for thawing lines such as, but not limited to, plastic and metal pipes. The deicer apparatus of the invention is denoted generally by the numeric label "100" and preferred embodiments thereof are labeled 100*a*, 100*b* and so on.

It is to be understood that the terms "top", "bottom", "side", "front", "rear", "upper", "lower", "vertical", "horizontal", "height", "width", "length" and the like are used herein merely to describe points of reference and do not limit the present invention to any specific orientation or configuration. The claimed apparatus and components may be of any size, shape or configuration suitable for operation of the apparatus and may be constructed of any suitable materials.

The terms "union tee" and "key" are regarded hereinafter as equivalent terms. The terms "deicer apparatus" and "deicer" are hereinafter regarded as equivalent terms. To aid the reader a parts reference list corresponding to part numbers shown in the Figures is provided in Table 1 (see FIG. 11).

Figure 1:
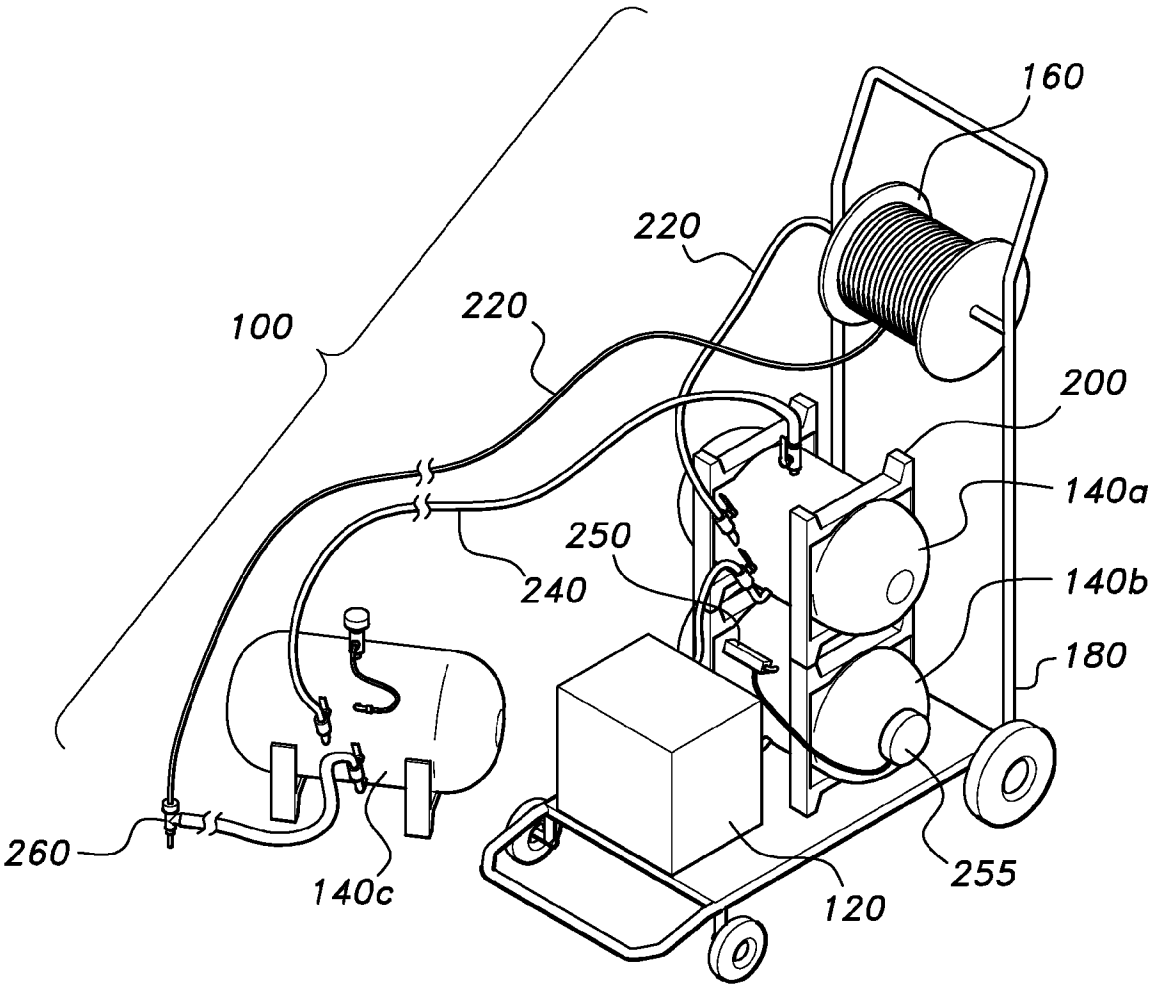
FIG. 1 shows a perspective view of one embodiment of the deicing apparatus according to the present invention.

FIG. 1 shows a perspective view of one embodiment of the deicing apparatus 100. In this embodiment the deicer 100 comprises an air compressor 120, first tank 140*a*, second tank 140*b*, third tank 140*c*, spool 160, carrying device 180, framework support 200, main hose 220, return line 240, thermostat 250, heater element 255, and union tee 260. The third tank 140*c* is not mounted on the carrying device 180. The carrying device 180 can be any suitable carrying apparatus such as, but not limited to, a cart fitted with wheels.

Figure 2:
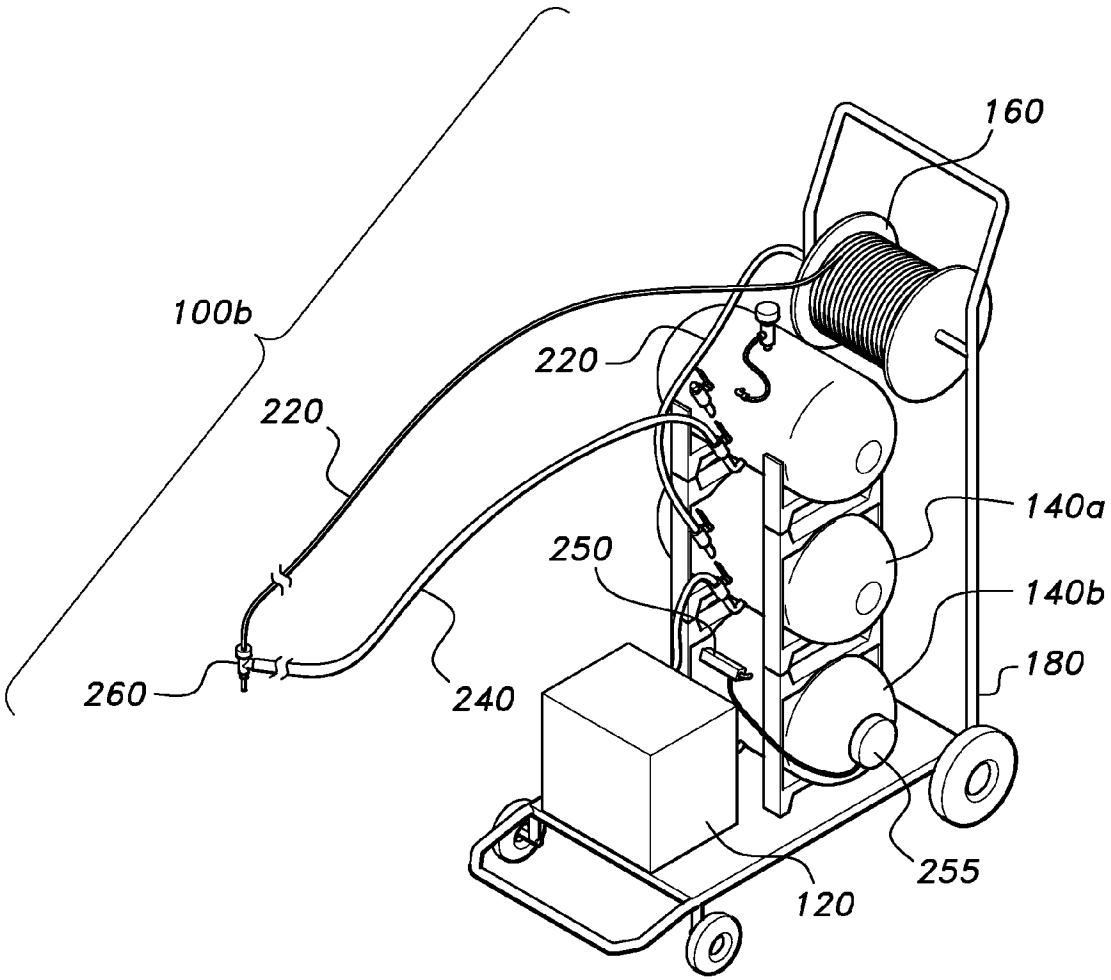
FIG. 2 shows a perspective view of one embodiment of the deicing apparatus according to the present invention.

FIG. 2 shows a perspective view of another embodiment of the deicing apparatus 100 (labeled in FIG. 2 as "100*b*"). The deicer 100*b* comprises an air compressor 120, first tank 140*a*, second tank 140*b*, third tank 140*c*, spool 160, carrying device 180, framework support 200, main hose 220, return line 240, thermostat 250, heater element 255, and union tee 260. The third tank 140*c* is mounted on the carrying device 180.

Figure 3:
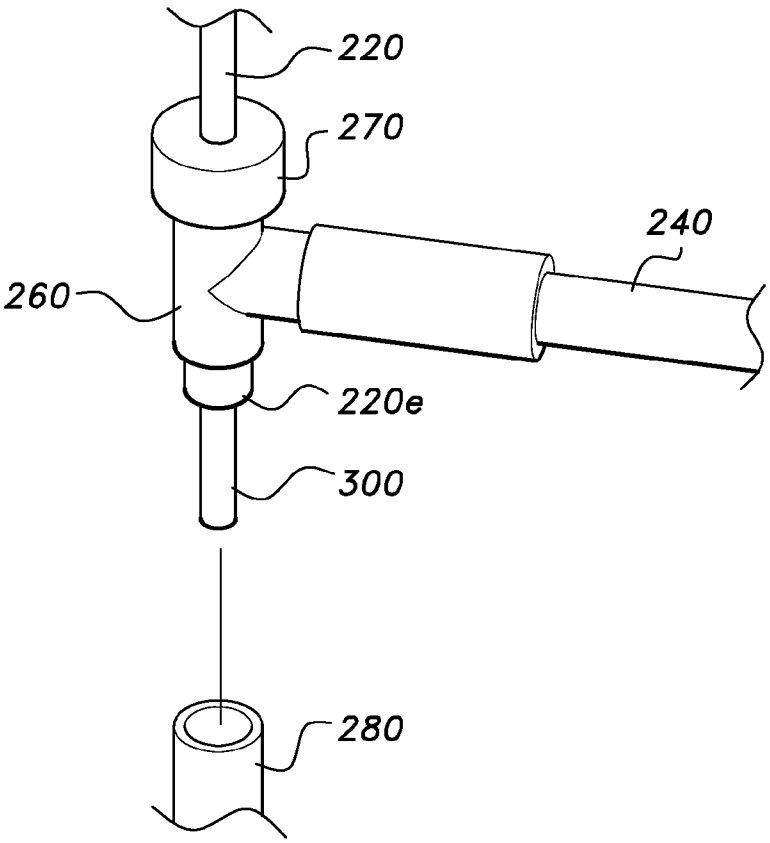
FIG. 3 shows a close up environmental view of a union tee according to the present invention.

FIG. 3 shows a close up environmental view of a union tee 260. During normal use of the deicer apparatus 100 the main hose 220 is manually pushed through the union tee 260. More specifically, as the ice in a frozen pipe 280 melts the main hose 220 is fed by an operator, such as a plumber, through the union tee 260 and into the interior of a frozen pipe 280 to ensure efficient melting of the ice inside the frozen pipe 280. Return water, which includes water originally frozen in pipe 280, is directed out of the union tee 260 and into return line 240 and thence to the third tank 140*c* which acts as a holding tank for returned water from pipe 280.

A plug 270 fits into one end of the union tee 260, and can be inserted into the union tee 260. The plug 270 ensures that return water from pipe 280 exits from the union tee 260 into return line 240. More specifically, the main hose 220 is in slidable engagement with plug 270 such that the main hose 220 can be fed through the plug 270 and thence through the union tee 260 without substantial leakage from the union tee 260.

Still referring to FIG. 3, an optional nozzle 300 is fitted to the end 220*e* of the main hose 220. The optional nozzle 300 can be made out of any suitable material such as polymer, but it is preferred that the optional nozzle 300 comprises heat conductive metal or metal alloy.

Figure 4:
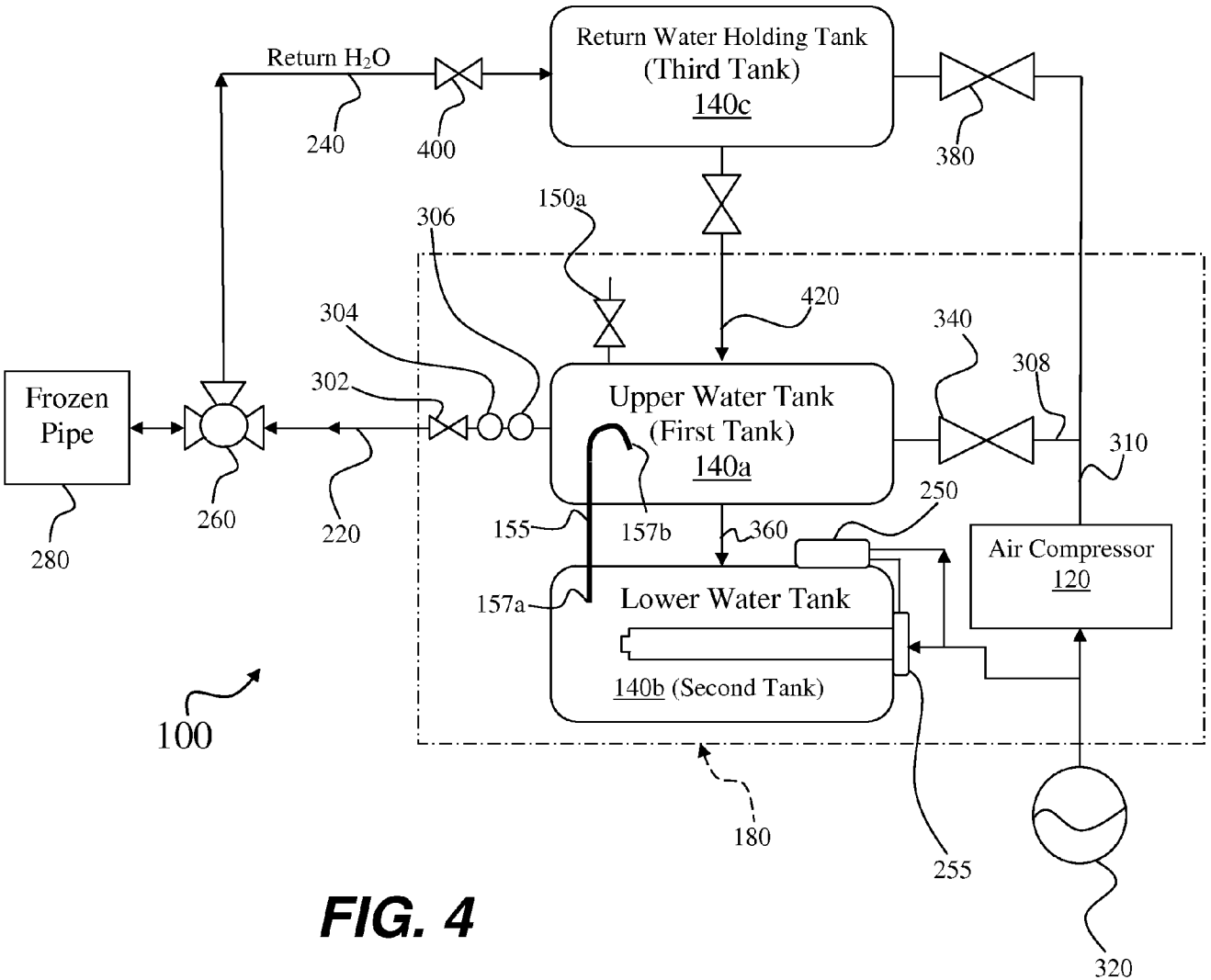
FIG. 4 is a schematic of one embodiment of the present invention corresponding to the deicing apparatus shown in FIG. 1.

FIG. 4 is a schematic of one embodiment of the present invention corresponding to the layout shown in FIG. 1. The meaning of part numbers can be found in Table 1 (FIG. 11). Startup water is supplied to first tank 140*a* via shutoff valve 150*a* and enters the second tank 140*b* from the first tank 140*a* via water line 360 to be heated by heating element 255. Heated water is transferred to the first tank 140*a* via siphon 155; the siphon 155 comprises first and second opposite ends 157*a* and 157*b*. The first end 157*a* is preferably located above the heater element 255 to keep the water level in second tank 140*b* above the heater element 255 to help prevent exposure of the heating element 255.

Still referring to FIG. 4, the main hose 220 is shown connected to a shut-off valve 302. A pressure regulator 304 and pressure switch 306 is shown located upstream of first tank 140*a*. Compressed air from compressor 120 is directed into first tank 140*a* via compressed airlines 308 and 310. Shutoff valve 340 is set to open position and shutoff valve 380 is set to closed position; this ensures compressed air is delivered to first tank 140*a*; if both valves 340 and 380 were set to open position no water would be delivered to hose 220 and/or water would not be returned to the third tank 140*c*, and the deicer apparatus 100 would not function properly.

Water is driven out of first tank 140*a* and thence to a frozen pipe 280, and return water is returned via return line 240 to third tank 140*c*. Once third tank 140*c* is full or nearly full the return water is transferred to the first tank 140*a* via water line 420; this is achieved by closing shutoff valve 340 and opening shutoff valve 380; compressed air then enters the third tank 140*c* to drive water from the third tank 140*c* to the first tank 140*a*.

Figure 5:
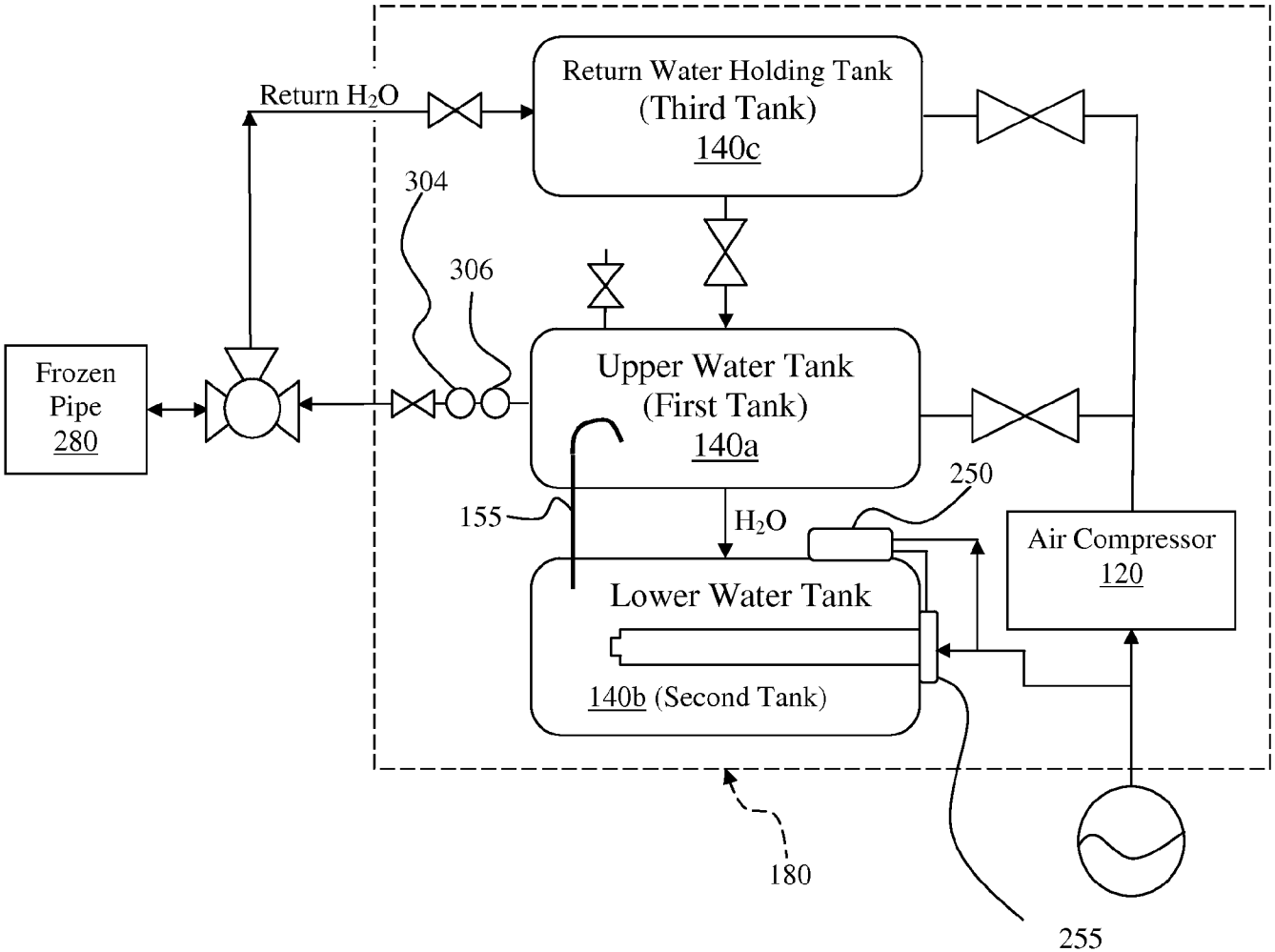
FIG. 5 is a schematic of one embodiment of the present invention corresponding to the deicing apparatus shown in FIG. 5.

The embodiment shown in FIG. 5 is essentially the same as that shown in FIG. 4 except that the three tanks 140*a*, 140*b* and 140*c* are all located on a carrying device 180.

Figure 6A:
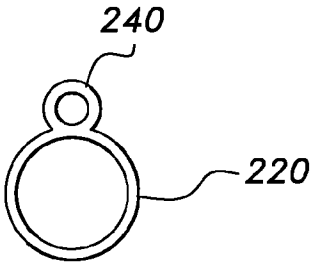
FIGS. 6A, 6B and 6C show various aspects of a deicing agent apparatus according to the present invention.
Figure 6B:
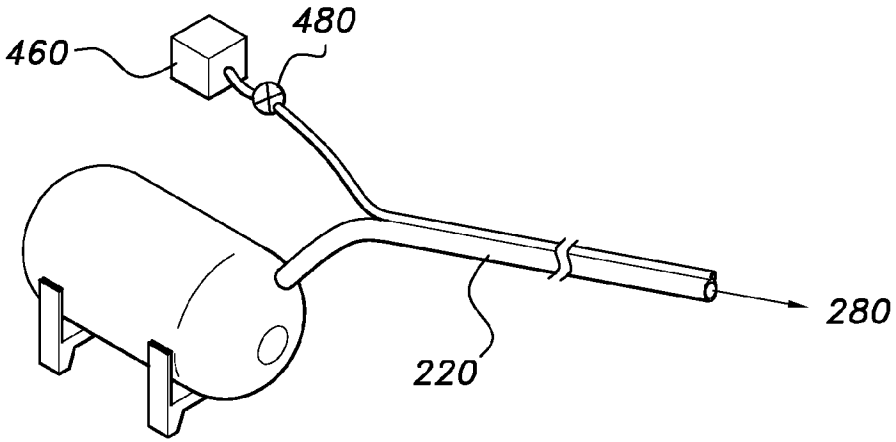
Figure 6C:
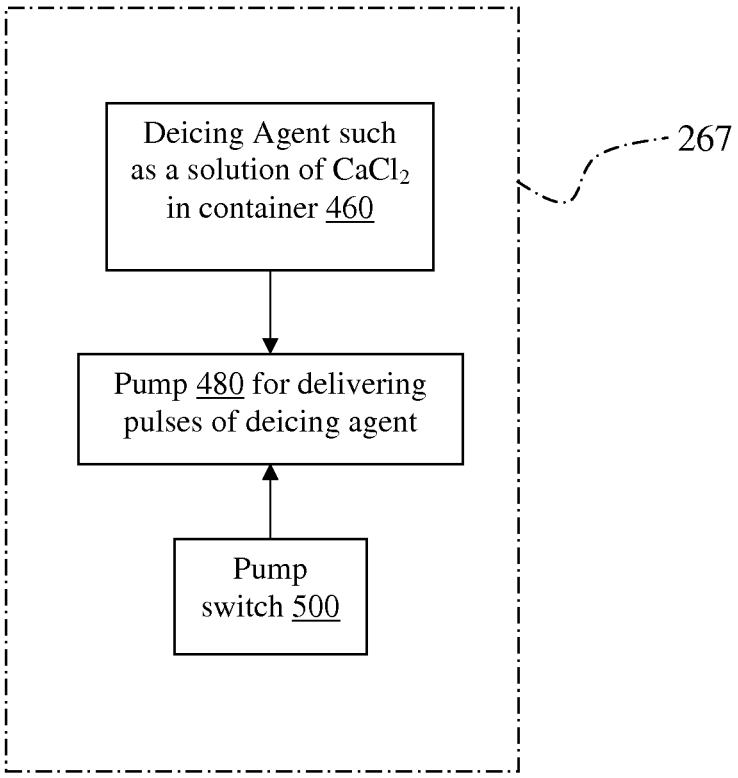

With respect to FIGS. 6A, 6B and 6C, a deicing agent is directed through an optional second deliver hose 440 and thence into a frozen pipe 280 to further aid thawing of frozen lines. The optional second deliver hose 440 can be attached or associated with the main hose 220 as shown in FIG. 6B. The deicing agent can be any suitable deicing agent such as, but not limited to, calcium chloride ($CaCl_2$) solution. The deicing agent can be pumped from a container 460 using a pump 480. A deicing agent pump system 267 is schematically represented by numeric label "267" in FIG. 6C.

The supply of such deicer agent can prove useful particularly when there is a shortage or water to fill and be heated in the lower tank. The pump shown schematically in FIG. 3 for delivering deicing agent to the second tube and hence to a frozen pipe can be any suitable pump such as a peristaltic pump, which can be useful for delivering pulses of deicing agent. In the alternative, a bleed off the air compressor can be applied to the second tube to deliver deicing agent.

Figure 7:
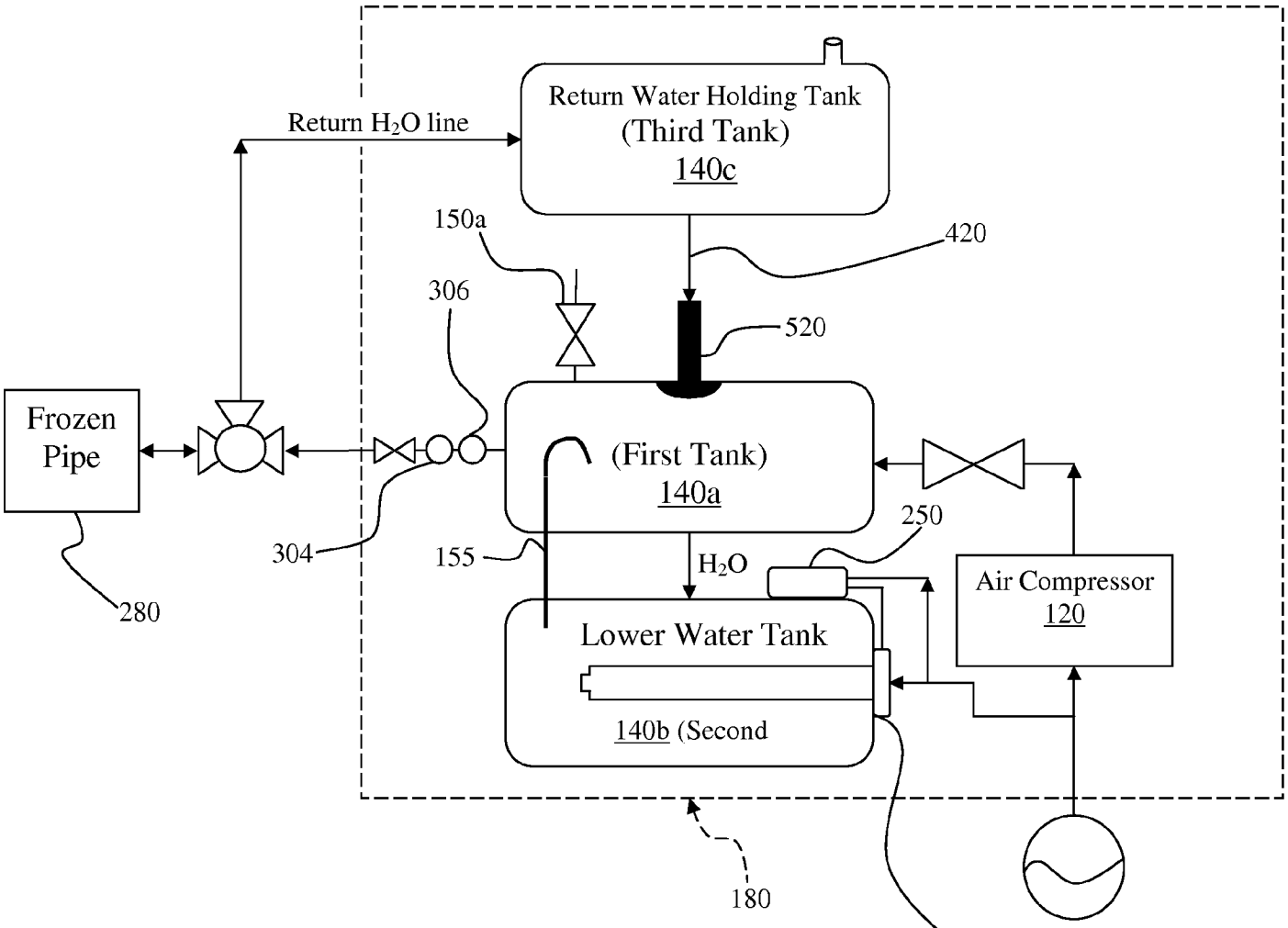
FIG. 7 shows an embodiment that makes use of a mushroom plug to feed water from a first tank to a second tank.
Figure 7A:
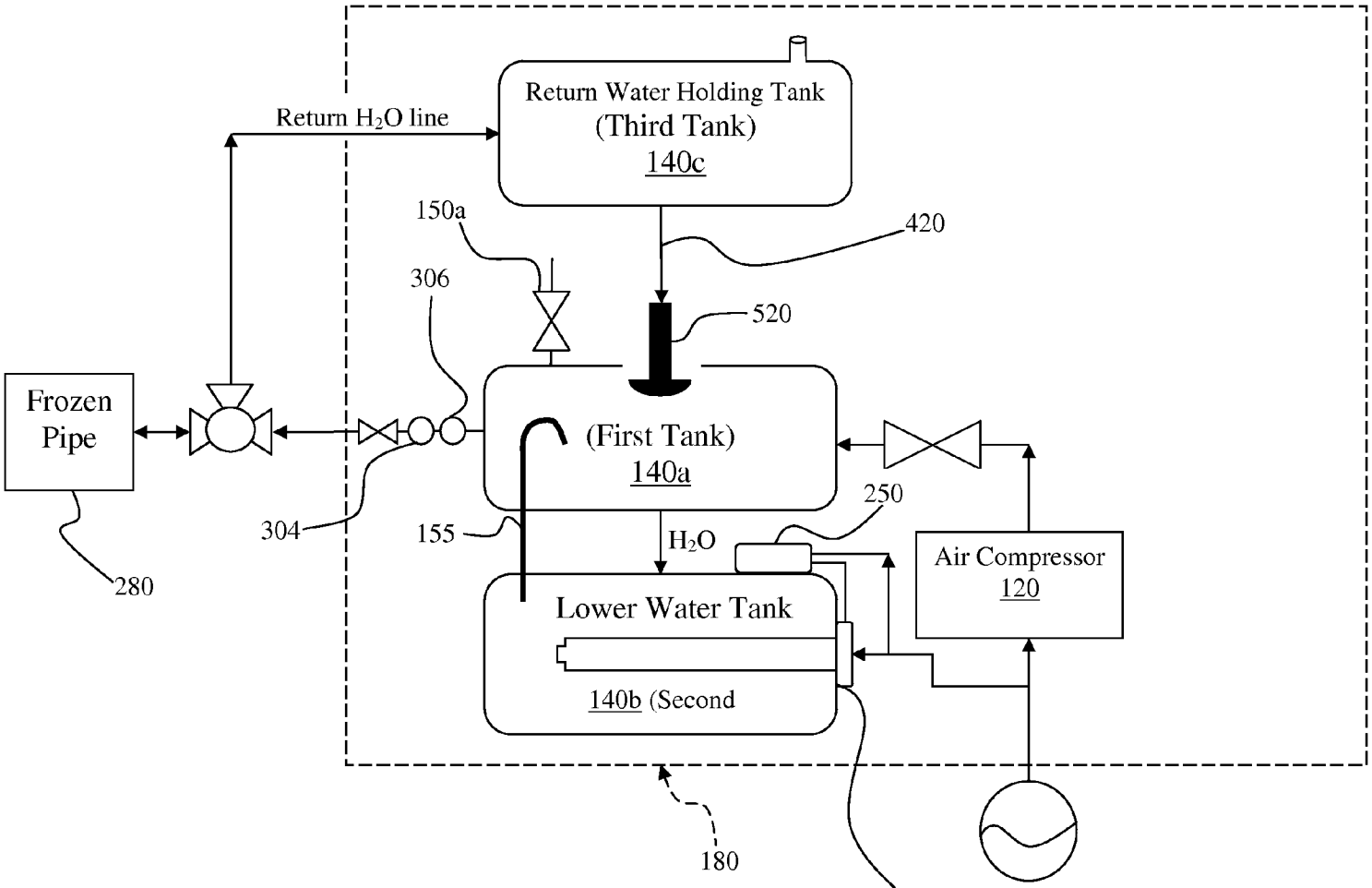
FIG. 7A shows the embodiment of FIG. 7, but with the mushroom plug in a dropped-down position.

FIG. 7 shows an embodiment that makes use of a mushroom plug 520 to feed water from the first tank 140*a* to the second tank 140*b*. Return water is transferred from the third tank 140*c* to the first tank 140*a* by gravity feed. More specifically, the air compressor 120 is switched off and air pressure bled from the first tank 140*a* via shutoff valve 150*a* which allows the mushroom plug 520 to drop down (see FIG. 7A) and return water to drain from the third tank 140*c* via water line 420 into the first tank 140*a*.

Figure 8:
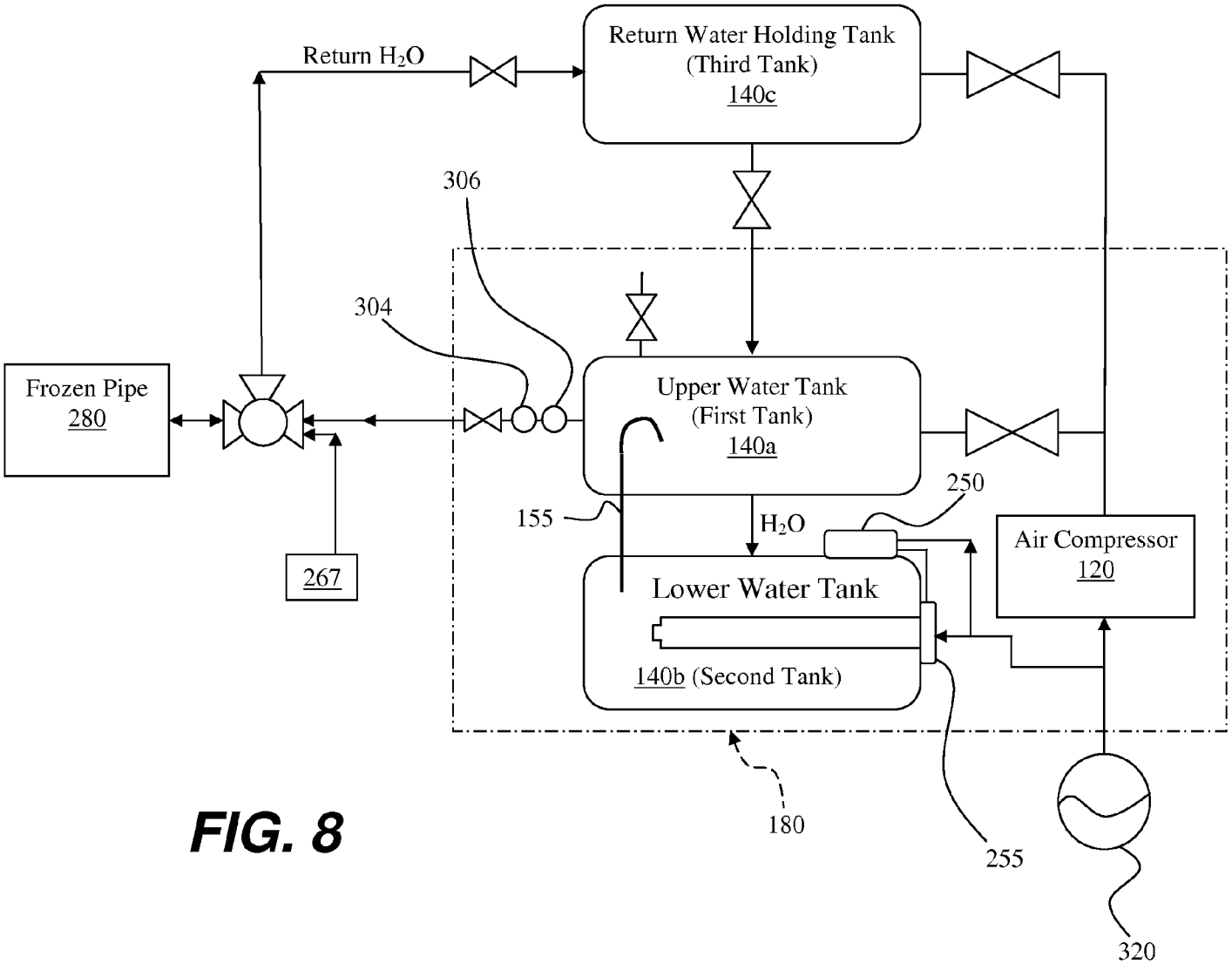
FIGS. 8 through 10 correspond to the embodiments shown respectively in FIGS. 4, 5 and 7 but incorporating a deicing agent pump system of FIG. 6C.
Figure 9:
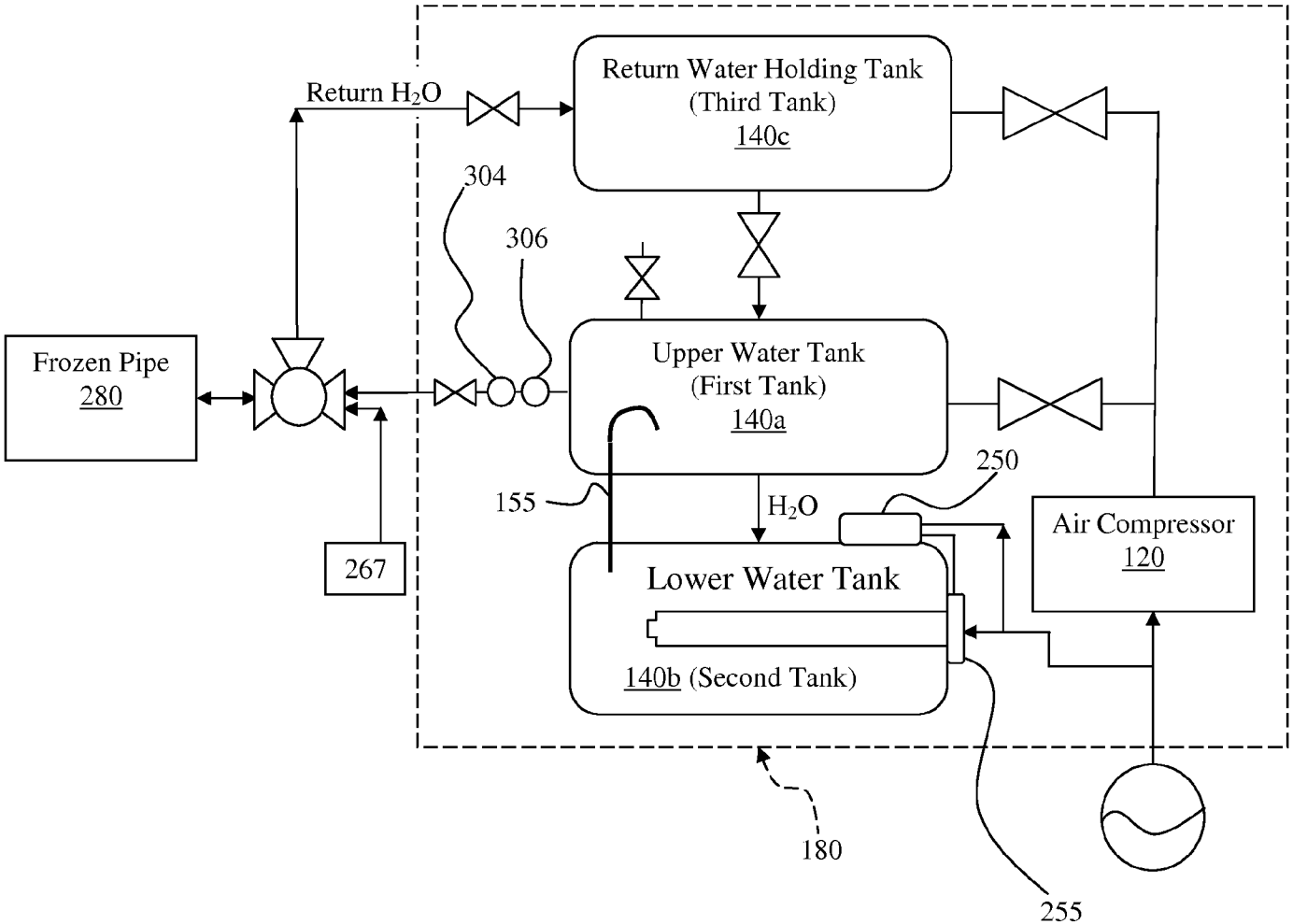
Figure 10:
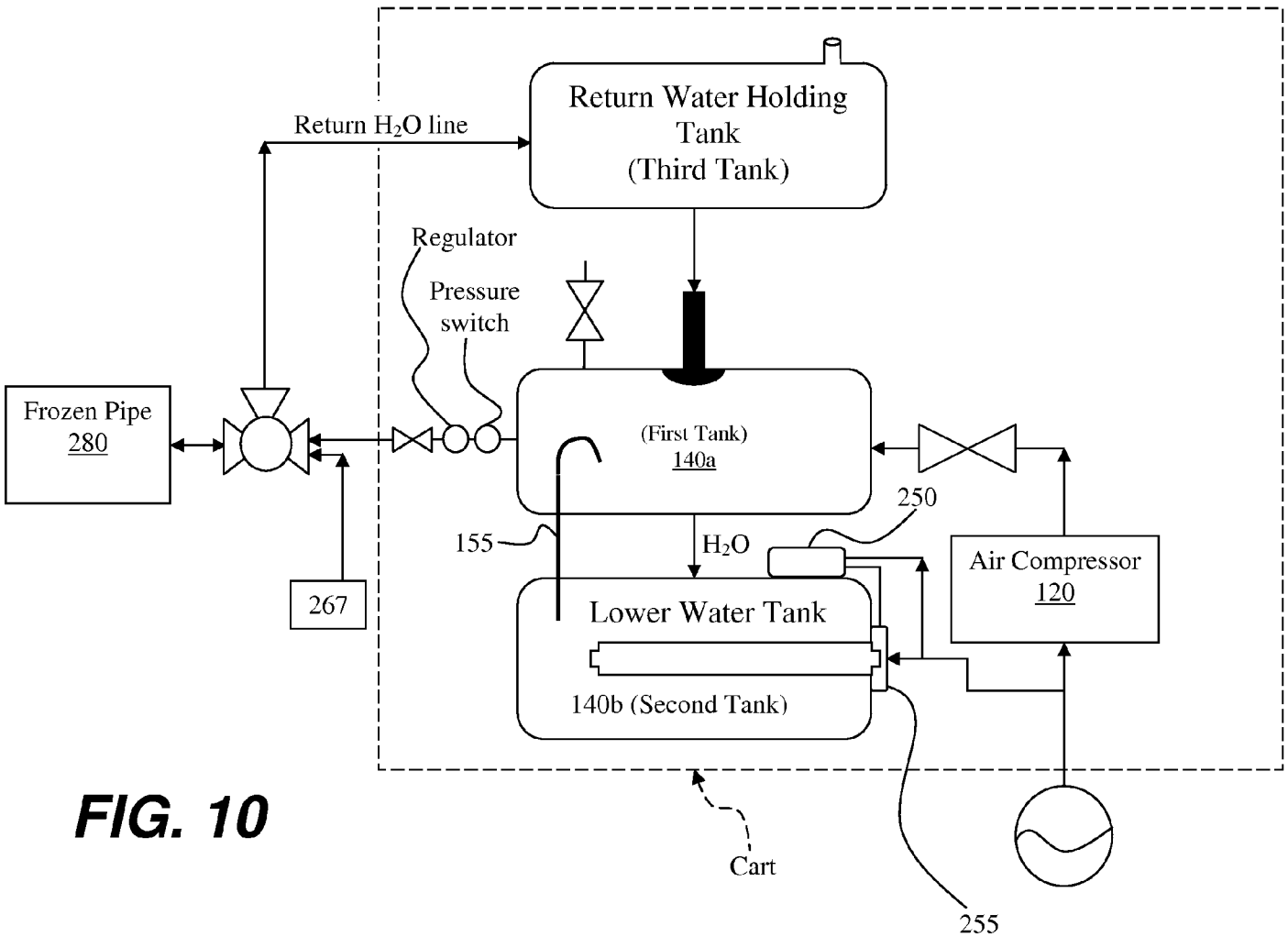

FIGS. 8 through 10 correspond to the embodiments shown respectively in FIGS. 4, 5 and 7. However, FIGS. 8 through 10 also include the deicing agent pump system 267 of FIG. 6C.

Rhino-liner sealant is optionally applied to the inner surface of tanks 140*a*, 140*b*, and 140*c* in any or all the embodiments disclosed in this application.

The invention being thus described, it will be evident that the same may be varied in many ways by a routineer in the applicable arts. Such variations are not to be regarded as a departure from the spirit and scope of the invention.

What is claimed is:

1. A deicing apparatus for deicing frozen pipes, comprising:

a first tank, a second tank, and a third tank, wherein said third tank is in located above said first tank and is in one fluid communication with said first tank via a mushroom plug, and said first tank is in another fluid communication with said second tank;

a siphon connecting said first and second tanks to conduct said another fluid communication;

a water heater located in said second tank;

a length of a first hose tubing having first and second ends thereof, with said first end of said first hose tubing terminating at said second tank, and said second end of said first hose tubing terminating at a nozzle;

a union tee for receiving said second end of said first hose tubing;

an air compressor selectively connected to said first tank, wherein during deicing said air compressor sends compressed air into said first tank to drive water from said first tank into said second tank with sufficient force to drive water from said second tank through said first hose tubing;

a water return line having a second hose tubing with first and second ends thereof, said first end of said second hose tubing terminating at the union tee, and said second end of said second hose tubing terminating at the third water tank, wherein said water return line is in fluid communication with said third tank, wherein during deicing return water is driven through said water return line to said third tank; and a carrying device on which said deicing apparatus is transported.

* * * * *